United States Patent [19]

Matsumoto et al.

[11] Patent Number: 4,522,483

[45] Date of Patent: Jun. 11, 1985

[54] IMAGE FORMING APPARATUS

[75] Inventors: Hiroshi Matsumoto; Junji Watanabe, both of Yokohama, Japan

[73] Assignee: Tokyo Shibaura Denki Kabushiki Kaisha, Kawasaki, Japan

[21] Appl. No.: 520,645

[22] Filed: Aug. 5, 1983

[30] Foreign Application Priority Data

Aug. 10, 1982 [JP] Japan ..... 57-138035

[51] Int. Cl.[3] ..... G03G 15/00

[52] U.S. Cl. ..... 355/3 R; 355/14 R

[58] Field of Search ..... 355/14 R, 14 C, 3 R, 355/3 DR

[56] References Cited

U.S. PATENT DOCUMENTS 4,287,461 9/1981 Promis et al. ..... 355/14 C X
4,344,697 8/1982 Matsumoto et al. ..... 355/14 C
4,365,888 12/1982 Hosaka et al. ..... 355/14 R
4,396,276 8/1983 Murasaki ..... 355/14 R X
4,436,408 3/1984 Inuzuka et al. ..... 355/14 R
4,464,044 8/1984 Matsuyama ..... 355/14 C X

FOREIGN PATENT DOCUMENTS 2343134 10/1975 Fed. Rep. of Germany .
2754023 6/1978 Fed. Rep. of Germany .

*Primary Examiner*—A. C. Prescott
*Attorney, Agent, or Firm*—Cushman, Darby & Cushman

[57] ABSTRACT

An electrophotograhic apparatus has a photoconductive drum which is disposed to be rotatable and on which a toner image corresponding to a document pattern is formed, a transfer unit for transferring a toner image to a paper sheet, and a cleaning unit for removing residual toner particles on the photoconductive drum. The cleaning unit has a cleaning blade which is always in sliding contact with the photoconductive drum in the copying and non-copying modes. The photoconductive drum rotates in the non-copying mode at a speed lower than that in the copying mode.

8 Claims, 10 Drawing Figures

IMAGE FORMING APPARATUS

BACKGROUND OF THE INVENTION

The present invention relates to an image forming apparatus such as an electrophotographic machine.

In general, toner is supplied to the surface of a photoconductive member of an electrophotographic machine when an electrostatic latent image is developed. Thereafter, a toner image is transferred to a paper sheet by a transfer process. However, some toner particles are left on the photoconductive member, and the surface of the photoconductive member is contaminated by the residual toner particles. In order to eliminate this drawback, a cleaning blade is brought into slidable contact with the surface of the photoconductive member to scrape the residual toner particles therefrom. However, when the surface of the photoconductive member is pressed by the cleaning blade for a long period of time or is heated upon motion of the cleaning blade, the surface shape and characteristics of the photoconductive member change, (i.e., so-called "pitting" occurs). In order to avoid this, the cleaning blade is brought into slidable contact with the photoconductive member to remove the residual toner particles in the copying mode, and is separated from the surface of the photoconductive member in the non-copying mode. In this manner, every time the cleaning blade is brought into contact with and separated from the surface of the photoconductive member in the copying mode and non-copying mode, the residual toner particles are removed, and are sent flying to the back of the cleaning blade and become attached thereto. Alternatively, developing medium carriers are inserted between the cleaning blade and the photoconductive member. As a result, a black stripe occurs in a copied sheet, and the surface of the photoconductive member is damaged.

SUMMARY OF THE INVENTION

It is an object of the present invention to provide an image forming apparatus having a cleaning device which prevents peating of the surface of the photoconductive member and scattering of residual toner particles.

According to the present invention, there is provided an image forming apparatus wherein a cleaning blade is in continuous contact with a photoconductive member and the photoconductive member rotates continuously, but at a lower speed in the stand-by mode than in the image forming mode.

DETAILED DESCRIPTION OF THE PREFERRED EMBODIMENTS

Figure 1:
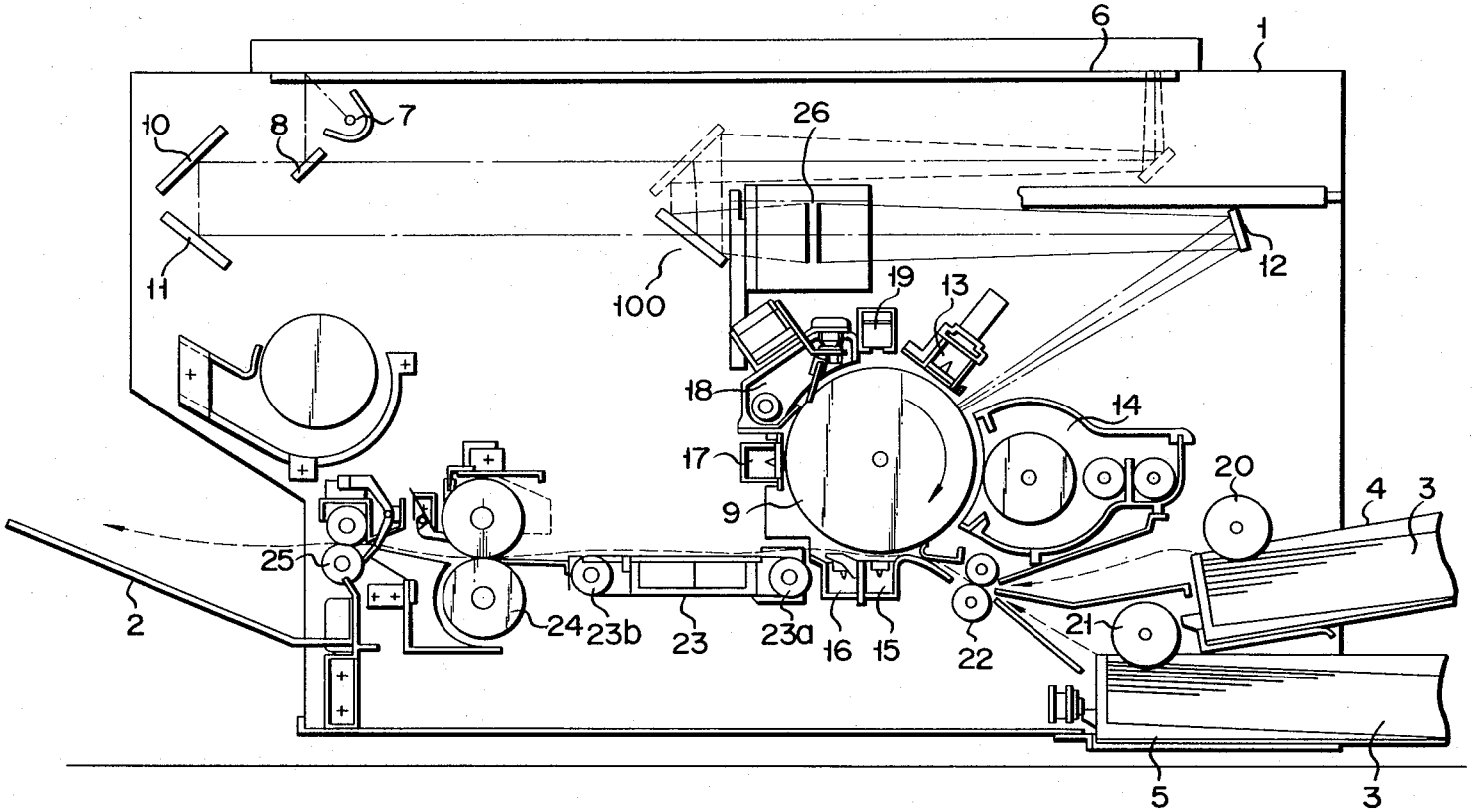
FIG. 1 is a sectional view showing the overall configuration of an image forming apparatus (i.e., electrophotographic apparatus) according to an embodiment of the present invention.

FIG. 1 shows an electrophotographic apparatus as an image forming apparatus. A paper discharging tray 2 is detachably mounted at the lower left portion of a cabinet 1 of the electrophotographic apparatus. An upper paper cassette 4 and a lower paper cassette 5 are detachably mounted at the lower right portion of the cabinet 1. A document table 6 is disposed on the cabinet 1. A photoconductive drum 9 is disposed below the document table 6. An exposure unit 100 is disposed between the document table 6 and photoconductive drum 9. The exposure unit 100 comprises an exposure lamp 7, mirrors 8, 10, 11 and 12, and a lens 26. The exposure lamp 7 can be horizontally moved along the document table 6. The mirror 8 receives light reflected by the document. The mirrors 10 and 11 horizontally reciprocate in synchronism with rotation of the photoconductive drum 9 to keep the length of an optical path constant and to receive light reflected by the mirror 8 and traveling along the optical path. The lens 26 focuses a document pattern image transmitted by the mirrors 10 and 11 on the surface of the photoconductive drum 9. A charger 13, a developer 14, a transfer charger 15, a paper separating charger 16, an erasing charger 17, a cleaning unit 18 and an erasing lamp 19 are disposed around the photoconductive drum 9 in the order named. Upper and lower paper feeding rollers 20 and 21 are disposed to feed sheets of paper from the upper and lower paper cassettes 4 and 5, respectively. The rollers 20 and 21 are put in tight contact with the uppermost paper sheets stored in the paper cassettes 4 and 5, respectively. Register rollers 22 are disposed near the lower portion of the photoconductive drum 9. The register rollers 22 are disposed to transfer a paper sheet 3 from the upper or lower paper cassette 4 or 5 to the photoconductive drum 9. A conveyer belt 23 looped over conveyer rollers **23*a* and 23*b* is disposed at the lower left side of the photoconductive drum 9. Heat rollers 24 and paper discharging rollers 25 are disposed along a path extending from the conveyer belt 23**.

Figure 2:
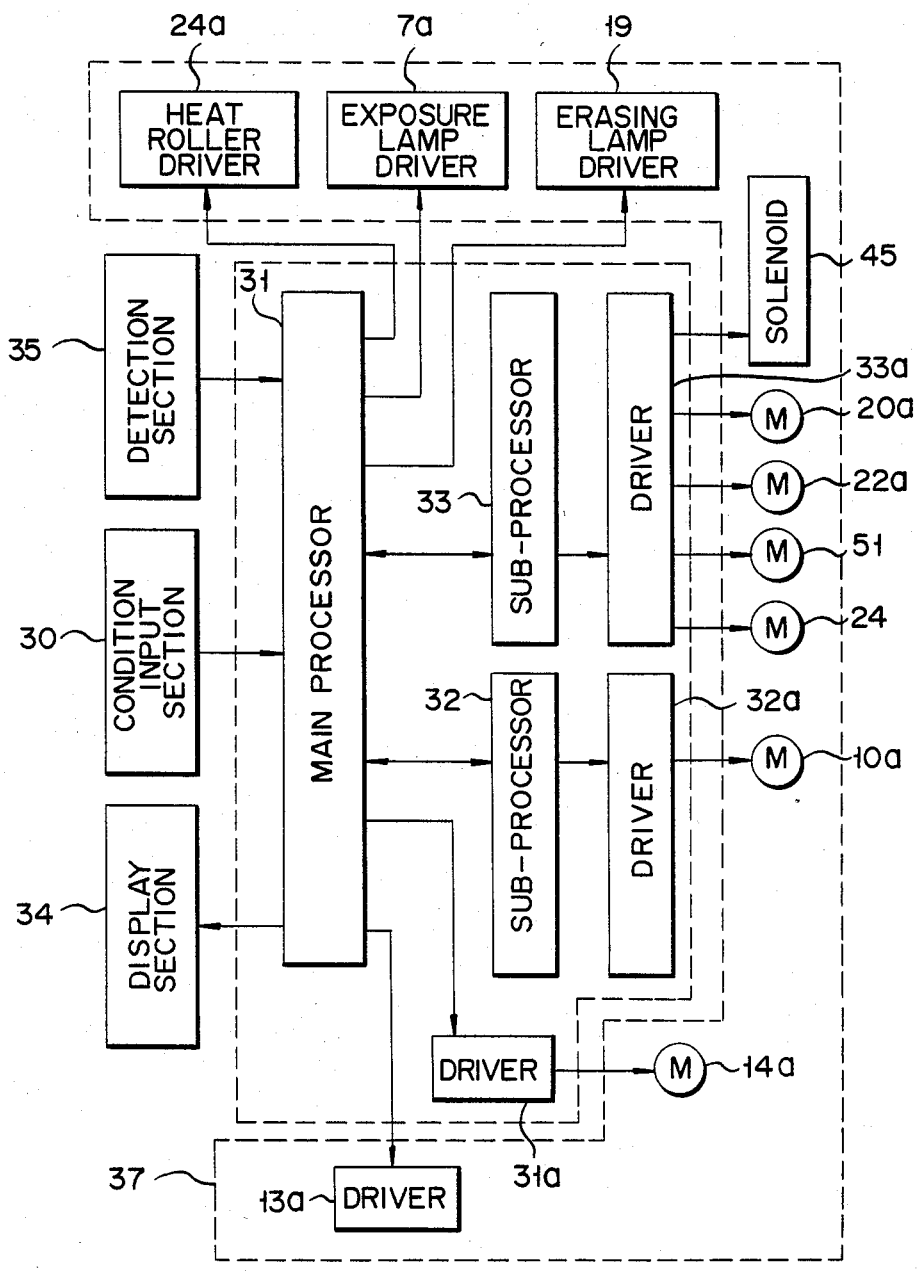
FIG. 2 is a block diagram of the electrophotographic apparatus shown in FIG. 1.

The control system of the electrophotographic apparatus shown in FIG. 1 will be described with reference to FIG. 2.

In a control section 29, the input/output (I/O) port of a main processor 31 constituted by a microprocessor is connected to the I/O ports of sub-processors 32 and 33 respectively constituted by CPUs. The output terminals of the sub-processors 32 and 33 are respectively connected to the input terminals of drivers **32*a* and 33*a*. The main processor 31 is connected to a condition input section 30, a display section 34 and a detection section 35. The main processor 31 is also connected to an exposure lamp driver 7*a*, an erasing lamp driver 19*a*, a charger driver 13*a*, and a heat roller driver 24*a* of a driving section 37. The driver 32*a* is connected to a stepping motor 10*a* for driving the mirror 10. The driver 33*a* is connected to stepping motors 20*a*, 22*a* and 24*b* for rotating the paper feeding roller 20, the register rollers 22** and the heat rollers 24, respectively; to a stepping motor 51 for rotating the photoconductive drum 9; and to a solenoid 45 for bringing a blade 42 into contact with or separating it from the photoconductive drum 9. An IC motor 14*a* for driving the developer 14 is connected to the main processor 31 through a driver 31*a*.

The main processor 31 includes: a ROM storing program data including operation steps corresponding to data from the condition input section 30 and the detection section 35, and a RAM for storing data updated in accordance with the data stored in the ROM.

The condition input section 30 comprises copy condition input switch elements such as a copy start switch arranged at a panel on the top surface of the cabinet 1 of the electrophotographic apparatus, ten keys for entering preset copy number data, a selection switch for selecting a paper size (i.e., for selecting a desired paper cassette), a copy stop key, and an exposure adjusting knob.

The display section 34 includes a preset copy number display arranged together with the copy condition input switches, a copied number display, a paper size display, a paper jam display, a paper empty display, a toner concentration display, and a copy-ready state display.

The detection section 35 has a paper-amount detector, a paper size detector, a paper jam detector, a paper separation failure detector, a door open detector, a fusing temperature detector, and a toner concentration detector. The paper-amount detector is arranged near the paper feeder to detect the number of paper sheets in the upper and lower paper cassettes 4 and 5. The paper jam detector is arranged near the paper discharging rollers 25 to detect a paper jam along the paper transport path from the paper feeding rollers to the paper discharging tray 2. The paper separation failure detector is arranged near the photoconductive drum 9 to detect whether or not the paper sheet is properly separated from the photoconductive drum. The door open detector comprises, for example, a microswitch to detect the open state of the photoelectric apparatus door. The fixing temperature detector serves to detect a temperature of the heat rollers 24.

Figure 3:
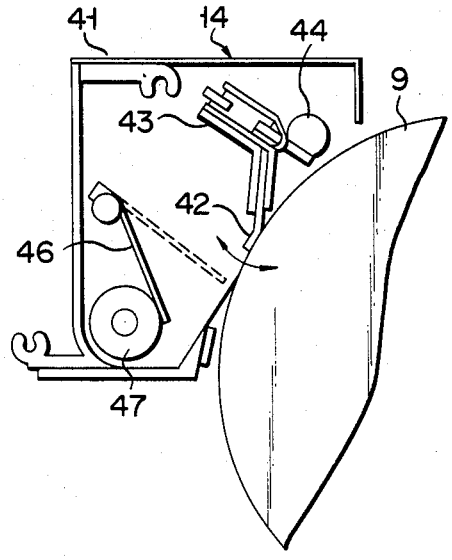
FIG. 3 is a side view of a cleaning device.
Figure 4:
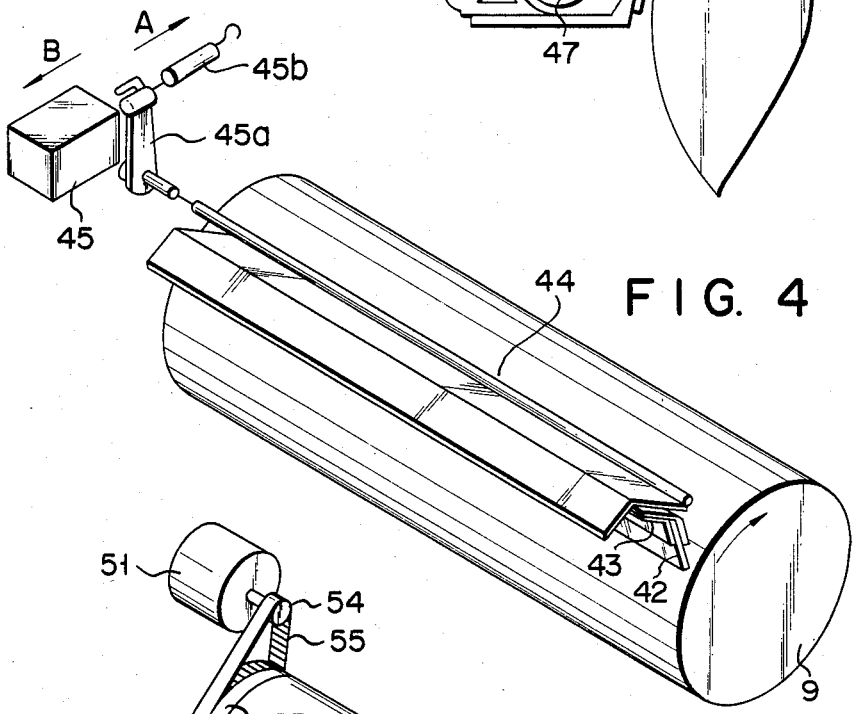
FIG. 4 is a perspective view of a cleaning blade and a photoconductive drum.

The cleaning unit 18 as the main feature of the present invention will be described in detail hereinafter. As shown in FIG. 3, the cleaning unit 18 is enclosed by a casing 41. The blade 42 can be brought into contact with or separated from the photoconductive drum 9 through an opening of the casing 41. The blade 42 is clamped by a holder 43 which is made of an elastic material such as rubber. The holder 43 is mounted on a support rod 44 disposed extending through the casing 41. The support rod 44 is coupled to an arm 45*a* of the solenoid 45, as shown in FIG. 4. The arm 45*a* is normally biased by a spring 45*b* in a direction indicated by arrow A. For this reason, when the solenoid 45 is deenergized, the arm 45*a* is urged in the direction indicated by arrow A. Along with this movement, the support rod 44 is pivoted, so that the blade 42 is separated from the photoconductive drum 9. However, when the solenoid 42 is energized, the arm 45*a* is urged in the direction indicated by arrow B, so that the blade 42 is brought into contact with the photoconductive drum 9.

A scraper 46 is pivotally disposed in the casing 41, as shown in FIG. 3. A screw conveyer 47 is disposed below the scraper 46. When the blade 42 is in contact with the photoconductive drum 9, the residual toner particles on the surface of the photoconductive drum 9 are scraped therefrom by the blade 42. The scraped toner particles drop from the pivoting scraper 46 without remaining near the blade 42. The fallen toner particles are removed to the outside by the screw conveyer 47.

Figure 5:
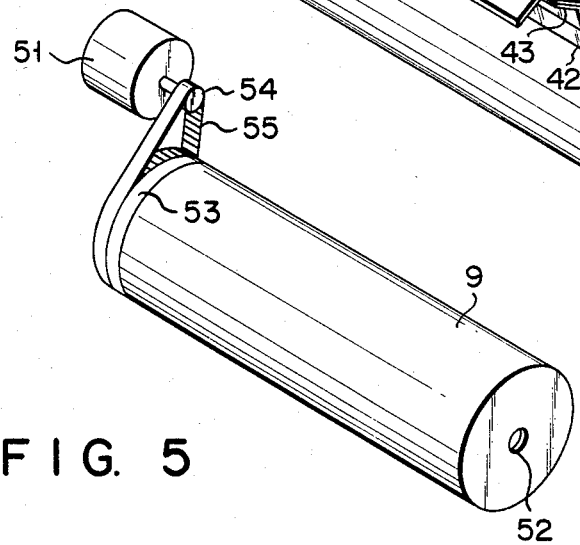
FIG. 5 is a perspective view of the photoconductive drum and a motor.

The photoconductive drum 9 is mounted on a drive shaft 52, as shown in FIG. 5. A drum pulley 53 is mounted on one end of the drive shaft 52. The drum pulley 53 is coupled to a motor pulley 54 of the stepping motor 51 by a timing belt 55. Therefore, the driving force of the stepping motor 51 is transmitted to the photoconductive drum 9 through the timing belt 55 and motor pulley 54. As a result, the photoconductive drum 9 is rotated.

Figure 6:
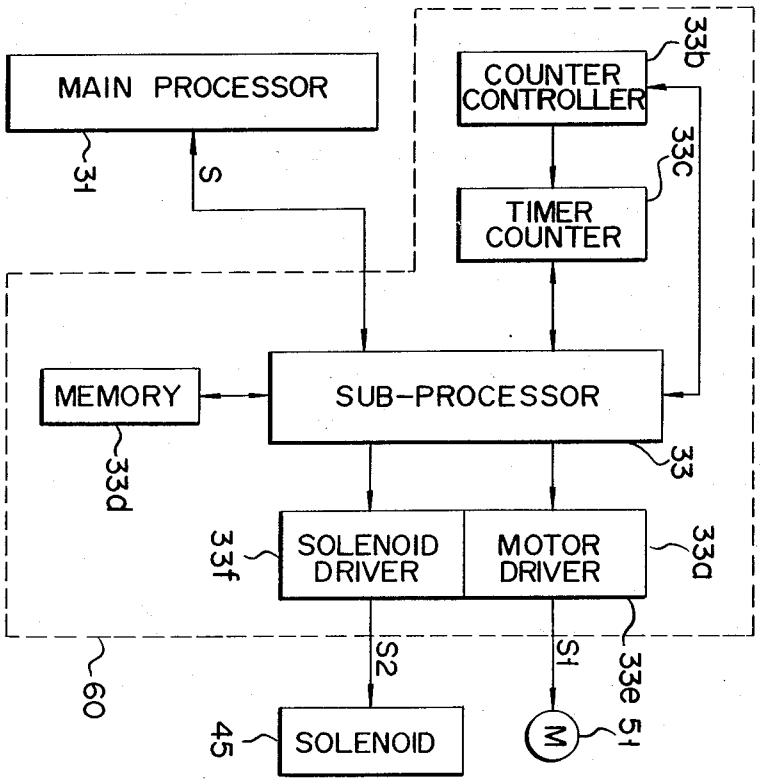
FIG. 6 is a block diagram of a stepping motor control system.

FIG. 6 shows a control circuit 60 for driving the stepping motor 51 and the blade mechanism. In this circuit, the sub-processor 33 is connected to the stepping motor 51 through a stepping motor driver 33*e* of the driver 33*a* and to the solenoid 45 through a solenoid driver 33*f*. A timer counter controller 33*b* is connected to a timer counter 33*c*. The timer counter 33*c* is connected to the sub-processor 33. The sub-processor 33 is also connected to the timer counter controller 33*b* directly. A memory 33*d* for storing excitation phase switching data used for driving the stepping motor 51 is connected to the sub-processor 33.

Figure 7:
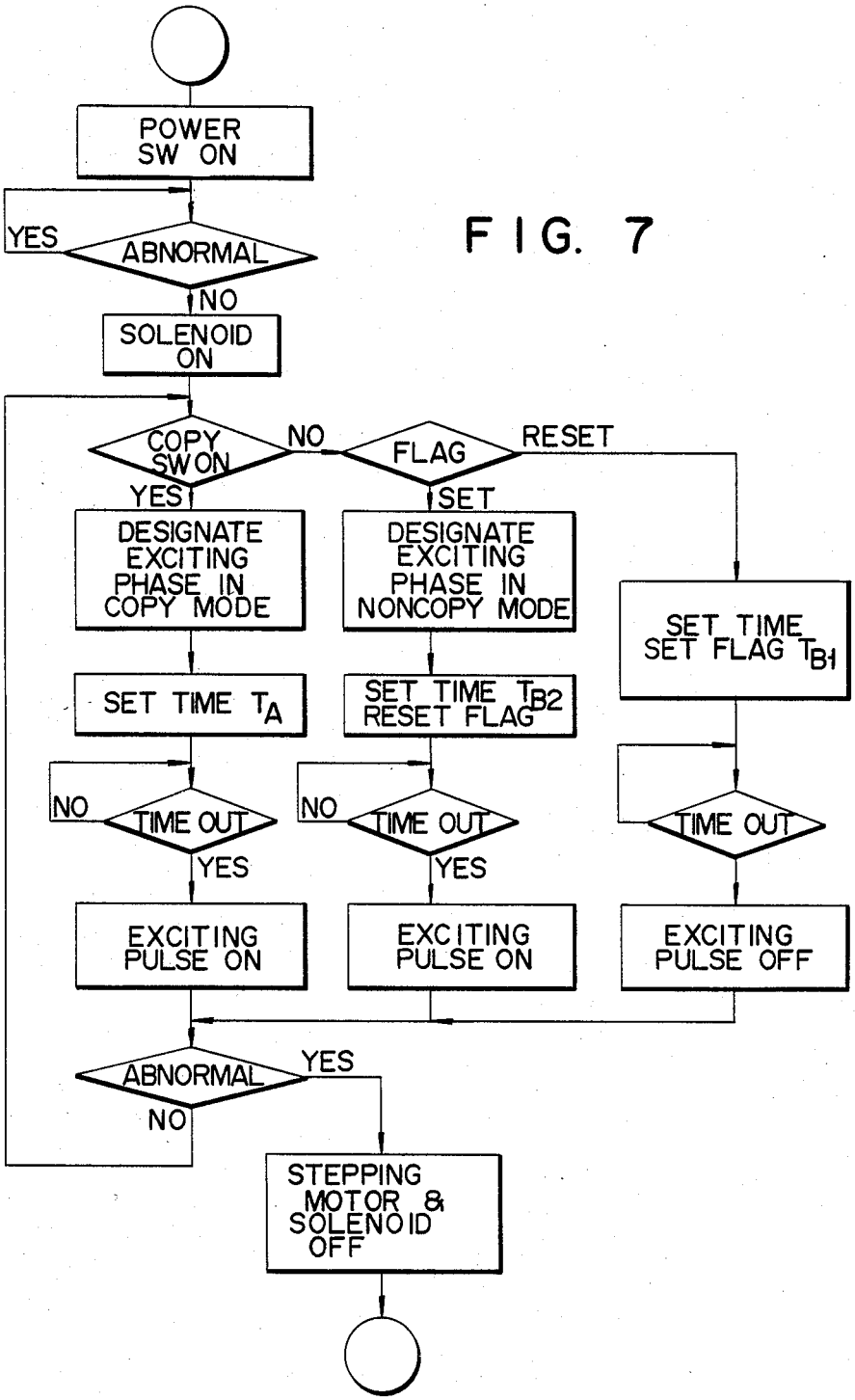
FIG. 7 is a flow chart for explaining the operation of the stepping motor control system.
Figure 8:
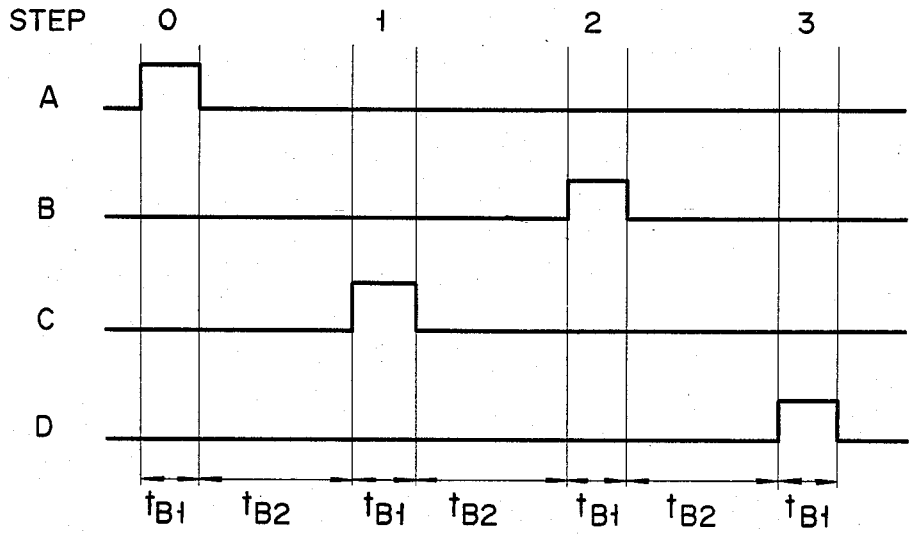
FIG. 8 is a timing chart of drive pulses for driving the stepping motor in the non-copying mode.
Figure 9:
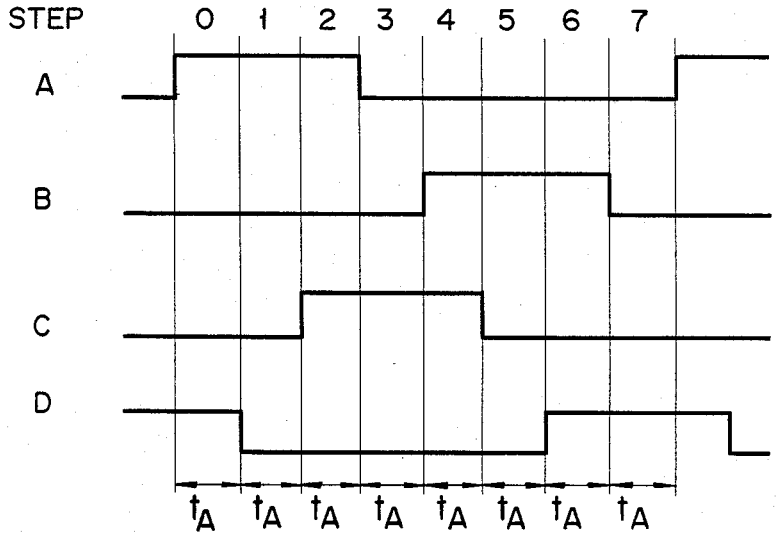
FIG. 9 is a timing chart of drive pulses for driving the stepping motor in the copying mode.

The operation of the control circuit 60 shown in FIG. 6 will be described with reference to the flow chart in FIG. 7. When the apparatus is powered, the sub-processor 33 operates to detect an abnormal operation condition, e.g., the door open state, in accordance with condition data from the main processor 31. When abnormal operating conditions are not detected, the sub-processor 33 supplies a solenoid energizing command to the solenoid driver 33*f*. The solenoid driver 33*f* energizes the solenoid 45, so that the blade 42 is brought into contact with the photoconductive drum 9. In this condition, the sub-processor 33 determines the ON or OFF state of the copy start switch in accordance with the condition data from the main processor 31. When it is determined that the copy start switch is OFF, the sub-controller 33 drives the stepping motor 51 at a speed corresponding to the non-copying mode (i.e., a speed lower than a speed corresponding to the copying mode). In this case, excitation phase designation data and time data $t_{B1}$ and $t_{B2}$ in the non-copying mode are read out from the memory 33*d*. In this case, if a flag is set, the excitation phase designation data is transferred to the motor driver 33*e*, and the time data $t_{B2}$ is set in the timer counter 33*c*. When the timer counter 33*c* is set in the manner as described, the flag is reset and the counter 33*c* counts down in response to a clock signal from the timer counter controller 33*b*. When the count of the counter 33*c* becomes zero (timeout), the sub-processor 33 supplies an excitation pulse to the stepping motor driver 33*e*. The motor driver 33*e* generates an excitation phase pulse (e.g., A-phase pulse) corresponding to the excitation phase designation data. Under this condition, the time data $t_{B1}$ is set in the counter 33*c* and the flag is set. When the timer counter 33*c* counts down and its count becomes zero (timeout), the motor driver 33*e* stops generating the excitation pulse. This state is indicated as step 0 in the cycle shown in FIG. 8. After the A-phase is excited, excitation phase designation data (i.e., C-phase designation data) together with time data $t_{B1}$ and $t_{B2}$ are read out from the memory 33*d* to advance the cycle to step 1. In step 1, the same operation as in step 0 is performed to obtain the C-phase pulse. Similarly, the C- and D-phase pulses are supplied in steps 2 and 3, respectively. After the D-phase is excited, the cycle returns to step 0. In this manner, the four phases of the stepping motor 51 are sequentially excited, so that the stepping motor 51 is rotated at a pulse rate of 1.5 pps. Thus, the photoconductive drum 9 is slowly rotated by the stepping motor 51. Meanwhile, the blade 42 of the cleaning unit 18 is in contact with the photoconductive drum 9 to clean the surface of the drum 9.

In the above condition, when the operator depresses a copy start switch, the sub-processor 33 determines that the copy start switch is ON in accordance with the condition data from the main controller 31. Therefore, the sub-processor 33 drives the stepping motor 51 at a speed corresponding to the copying mode (a speed higher than the speed corresponding to the non-copying mode). In this case, the stepping motor 51 is driven for a time interval corresponding to steps 0 to 7 as one cycle. More particularly, in step 0, the A- and D-phase designation data and time data $t_A$ are read out from the memory 33*d*. The sub-controller 33 designates the A- and D-phases and sets the time data $t_A$ in the timer counter 33*c*. The timer counter 33*c* counts down in response to the clock signal. When the count of the counter 33*c* becomes zero (timeout), the sub-processor 33 detects the timeout state and supplies the excitation pulse to the motor driver 33*e*. The motor driver 33*e* supplies A- and D-phase excitation pulses to the stepping motor 51, thereby rotating the stepping motor 51 by one step. Thereafter, the sub-processor 33 checks if an abnormal condition is present. If no abnormal condition is determined, the cycle advances to step 1. In step 1, A-phase designation data and time data $t_A$ are read out from the memory 33*d*. Therefore, in step 1, the A-phase of the stepping motor 51 is excited, and the stepping motor 51 is rotated by one step. Similarly, the A- and C-phases are excited in step 2, and only the C-phase is excited in step 3. The B- and C-phases are excited in step 4; only the B-phase is excited in step 5; and the B- and D-phases are excited in step 6. After the D-phase is excited in step 7, the cycle returns to step 0. In this manner, the excitation phases are switched every time data $t_A$. The stepping motor 51 is constantly rotated at a pulse rate of, for example, 1,500 pps.

When the stepping motor 51 is rotated at the speed corresponding to the copying mode, the copy operation is started. The photoconductive drum 9 is charged by the charger 13, and is exposed by the exposure unit 100 in accordance with the pattern of the document placed on the document table 6. A latent image formed by exposure on the photoconductive drum 9 is developed by the developer 14 to a toner image. For example, when the paper sheet 3 is fed by the paper feed roller 20 from the paper cassette 4 to the register rollers 22, the register rollers 22 convey the paper sheet 3 to a portion between the photoconductive drum 9 and the transfer charger 15. The transfer charger 15 transfers the toner image formed on the photoconductive drum 9 to the paper sheet 3. The image-transferred paper sheet 3 is separated by the paper separating charger 16 from the photoconductive drum 9. The separated paper sheet is then conveyed to the conveyer belt 23. When the transferred paper sheet 3 is conveyed by the conveyer belt 23 to the heat rollers 24, the toner image on the paper sheet 3 is fixed by the heat rollers 24. The paper sheet 3 is discharged as a copy through the heat rollers 24 to the tray 2 by means of the discharging rollers 25.

After the copying operation is performed and completed as described above, the control circuit 60 in FIG. 6 is set in the non-copying mode, and the photoconductive drum 9 continues to rotate at a speed which is 1/1,000 the speed corresponding to the copying mode. Therefore, the blade 42 of the cleaning unit 13 continues to scrape the residual toner particles from the photoconductive drum 9 even after the copying operation is completed.

When an abnormal operating condition such as the door open state and paper jam occurs, irrespective of the operating mode (copying or non-copying), the sub-processor 33 detects an abnormal condition in accordance with the condition data from the main controller 31. In this case, the sub-processor 33 supplies an operation interrupt command to the stepping motor driver 33*e* and the solenoid driver 33*f*, thereby stopping the stepping motor 51 and the solenoid 45. Therefore, the photoconductive drum 9 is stopped, and the solenoid 45 is deenergized. As a result, the blade 42 is separated from the photoconductive drum 9. When the abnormal condition is eliminated, the blade 42 is brought into contact with the photoconductive drum 9 again in accordance with the flow in FIG. 7, and the photoconductive drum 9 continues to rotate.

Figure 10:
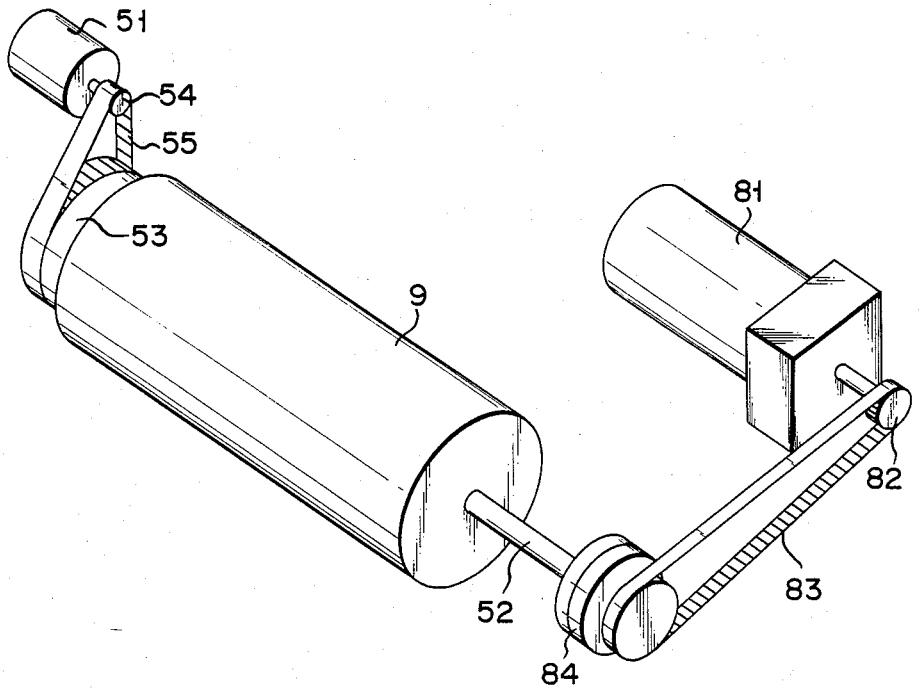
FIG. 10 is a perspective view of a photoconductive drum and a drive system of an electrophotographic apparatus according to another embodiment of the present invention.

An image forming apparatus according to another embodiment of the present invention will be described with reference to FIG. 10. According to this embodiment, a DC motor 81 is coupled to the other end of the drive shaft 52 by an electromagnetic clutch 84, a belt 83 and a motor gear 82. The DC motor 81 is driven in the copying mode to rotate the photoconductive drum 9 at a speed corresponding to the copying mode. In the non-copying mode, the DC motor 81 is disconnected by the electromagnetic clutch 84 from the drive shaft 52, and the photoconductive drum 9 is rotated by the stepping motor 51 at a low speed. In this case, the memory 33*d* of the control circuit 60 in FIG. 6 stores stepping motor drive data in the non-copying mode. The stepping motor 51 is driven in accordance with this data. In the copying mode, the sub-processor 33 drives the electromagnetic clutch 84 and the DC motor 81.

According to the present invention as described above, the photoconductive drum continues to be rotated at a low speed (lower than the speed corresponding to the copying mode) in the non-copying mode. Even if the blade is always in slidable contact with the photoconductive drum, the blade is not pressed against a given part of the drum for a long period of time, thereby preventing pitting. Furthermore, since the blade is not separated from the photoconductive drum, the residual toner particles are not sent flying to the back of the blade, nor do they become attached thereon. As a result, no black stripe appears on the copy, and the photoconductive drum is not damaged by developing medium carriers.

In the above embodiment, the rotational speed of the photoconductive drum in the non-copying mode is 1/1,000 that in the copying mode. However, the rotational speed in the non-copying mode may vary in the range between 1/100 and 1/1,000 that in the copying mode. When the rotational speed of the drum in the non-copying mode becomes excessively low, the blade tends to be urged in the opposite direction due to its restoration force. For this reason, the rotational speed of the drum in the non-copying mode has a lower limit.

In the above embodiment, the photoconductive drum is rotated at a given low speed in the non-copying mode. However, the drum may be intermittently rotated at a high speed in a non-copying period. In this case, an excitation pulse having a high frequency is intermittently supplied to the stepping motor. The type of photoconductive member is not limited to a drum type but may be extended to a plate type.

What is claimed is:

1. An image forming apparatus comprising:

photoconductive means disposed to be movable;

driving means for driving said photoconductive means;

charging means, disposed near said photoconductive means, for charging said photoconductive means;

exposure means for exposing said photoconductive means to form a latent image corresponding to a document pattern on said photoconductive means;

developing means for developing the latent image on said photoconductive means into a visible image;

transfer means for transferring the visible image onto a paper sheet;

cleaning means, disposed in contact with said photoconductive means, for removing residual toner material left on said photoconductive means; and drive signal supplying means for supplying drive signals to said driving means so as to set said photoconductive means in different driving conditions for an image forming mode and an image forming standby mode, respectively.

2. An apparatus according to claim 1, wherein said drive signal supplying means comprises means for generating a first signal to rotate said photoconductive means at a first speed in the image forming mode and a second signal to rotate said photoconductive means at a second speed in the image forming standby mode, the second speed being lower than the first speed.

3. An image forming apparatus comprising:

a photoconductive drum disposed to be rotatable;

driving means for rotating said photoconductive drum;

charging means for charging said photoconductive drum;

exposure means for exposing said photoconductive drum to form a latent image corresponding to a document pattern thereon;

developing means for developing the latent image by supplying developing powders into the latent image on said photoconductive drum;

transfer means for transferring the developed image onto a paper sheet;

cleaning means having a cleaning blade which is in contact with said photoconductive drum so as to remove residual developing powders left on said photoconductive drum; and drive signal supplying means for supplying drive signals to said driving means so as to set said photoconductive drum in different driving conditions in an image forming mode and an image forming standby mode, respectively.

4. An apparatus according to claim 3, wherein said driving means comprises a stepping motor, and said drive signal supplying means supplies a first period drive pulse to said stepping motor in the image forming mode and a second period drive pulse to said stepping motor in the image forming standby mode, the second period drive pulse having a frequency lower than that of the first period drive pulse.

5. An apparatus according to claim 3, wherein said driving means has a DC motor for driving said photoconductive drum at a first speed in the image forming mode and a stepping motor for rotating said photoconductive drum at a second speed in the image forming standby mode, the second speed being lower than the first speed.

6. An apparatus according to claim 3, wherein said drive signal supplying means comprises means for supplying a signal to said driving means so as to rotate said photoconductive drum at a predetermined speed in the image forming mode and for supplying another signal to said driving means so as to intermittently rotate said photoconductive drum in the image forming standby mode.

7. An apparatus according to claim 3, wherein said drive signal supplying means comprises: memory means for storing time data corresponding to the first speed at which said photoconductive drum rotates in the image forming mode and another time data corresponding to the second speed at which said photoconductive drum rotates in the image forming standby mode; timer counter means set by one of the time data which is read out from said memory means and times out in accordance with said one of the time data; and means for driving said driving means in response to a timeout signal from said timer counter means.

8. An apparatus according to claim 3, wherein said cleaning means has solenoid means adapted to be energized to bring said cleaning blade into contact with said photoconductive drum and deenergized to separate said cleaning blade from said photoconductive drum upon detection of an abnormal condition.

* * * * *